US005095575A

United States Patent [19]

Jarecki et al.

[11] Patent Number: 5,095,575

[45] Date of Patent: Mar. 17, 1992

[54] ADJUSTABLE SHIELDED PAINT ROLLER

[75] Inventors: James J. Jarecki, Greendale, Wis.; Leon C. Clouser, Lombard; Insoon Park, Chicago, both of Ill.

[73] Assignee: EZ Painter Corporation, Milwaukee, Wis.

[21] Appl. No.: 360,556

[22] Filed: Jun. 2, 1989

Related U.S. Application Data

[63] Continuation-in-part of Ser. No. 149,045, Jan. 26, 1988.

[51] Int. Cl.[5] ..... A46B 5/02

[52] U.S. Cl. ..... 15/230.11; 15/248 R; 15/247; 15/248 A; 134/182; 401/218

[58] Field of Search ..... 15/230.11, 248 R, 248 A, 15/247, 257.6, 236.1, 236.03, 230.14, 230, 175, 119 A, 104.92, 104.93, 104.94; 401/15, 197, 218, 219, 220; 134/138, 200, 182; 366/220, 47, 228, 224, 225

[56] References Cited

U.S. PATENT DOCUMENTS

| | | | |
|---|---|---|---|
| 210,849 | 12/1878 | Goss | 15/257.6 |
| 228,692 | 6/1880 | Stichter | 15/257.6 |
| 576,073 | 1/1897 | Mason | 15/257.6 |
| 1,131,117 | 3/1915 | Clemens | 401/208 |
| 2,453,583 | 11/1948 | Muller | 366/47 |
| 2,801,833 | 8/1957 | Huge | 366/47 |
| 2,807,040 | 9/1957 | Adams et al. | 15/248 X |
| 2,902,706 | 9/1959 | Gaetze | 15/248 A |
| 3,274,637 | 9/1966 | Schulze | 15/248 A |
| 3,378,872 | 4/1968 | Frontera | 15/230.11 |
| 3,409,929 | 11/1968 | Fisher | 15/248 A |
| 3,654,658 | 4/1972 | Kovacs | 15/248 A |
| 3,721,502 | 3/1973 | Ognibene | 401/220 |
| 3,748,678 | 7/1973 | Ballou | 401/219 |
| 4,063,325 | 12/1977 | Lizak | 15/248 A |
| 4,091,493 | 5/1978 | Weiss | 15/248 A |
| 4,128,350 | 12/1978 | Gamache | 401/208 |
| 4,307,520 | 12/1981 | Lutz | 366/228 |
| 4,571,769 | 2/1986 | Ford | 15/230.11 |
| 4,765,353 | 8/1988 | Rhoades | 134/138 |
| 4,821,362 | 4/1989 | Kolb | 15/248 A |

FOREIGN PATENT DOCUMENTS

| | | | |
|---|---|---|---|
| 164012 | 9/1949 | Austria | 402/218 |
| 3112231 | 10/1982 | Fed. Rep. of Germany | 99/300 |
| 2032793 | 5/1980 | United Kingdom | 366/47 |

*Primary Examiner*—Frankie L. Stinson
*Attorney, Agent, or Firm*—Baker & McKenzie

[57] ABSTRACT

A paint roller having an ajustable shield is disclosed. The shield is adjustable by the user from a position of minimum shielding, which facilitates loading the roller with paint, to a position of maximum shielding which provides maximum spatter protection. The adjustment of the shield may quickly and easily be made with one hand by the user, and particularly by the same hand by which the roller is held.

1 Claim, 2 Drawing Sheets

ADJUSTABLE SHIELDED PAINT ROLLER

This is a continuation-in-part of application Ser. No. 149,045, filed Jan. 26, 1988.

BACKGROUND AND SUMMARY OF THE INVENTION

This invention relates generally to shielded paint rollers and, more specifically, to a shielded paint roller having an adjustable shield whereby the user can quickly and easily vary the coverage of the roller by the shield.

Shielded paint rollers generally have the advantage of reducing, or at least confining, paint spatter associated with roller painting. Many variations of the basic shielded roller concept are known. The extent of shielding varies widely, however. A modest shielding effect, which is still effective to dramatically reduce paint splatter, is obtained when substantially less than 180° of coverage of the roller is available; for example, on the order of about 90°. This degree of shielding has the advantage of enabling paint to be loaded on the roller from a paint tray almost as quickly and easily as a non-shielded roller since there is little likelihood that the roller assembly will be presented to the pool of paint in the paint tray at such an angle that the edges of the shield will contact the paint and therefore drip following removal. In addition, such a roller is easier to use with a handle extension for ceiling work, or for corner work, than an extensively shielded (i.e.: up to about 180° of circumference) roller. Such a roller is not as effective, however, in protecting the user from paint spatter during use as a more extensively shielded roller is.

An extensively shielded roller, by the same token, requires greater user skill to load with paint so as to avoid post-loading dripping, and to work on ceilings or in corners than the partially shielded roller, but it has the very great advantage of providing maximum spatter protection to the user and the surroundings.

SUMMARY OF THE INVENTION

The invention is a paint roller assembly which includes a roller, a handle, means for supporting the roller for rotation with respect to the handle and an adjustable shield means for substantially reducing or eliminating spatter during use, the adjustable shield means including a first, fixed shield and a second, adjustable shield which may be quickly and easily operated by a user to extend from, and retract into, the fixed shield.

Accordingly, a primary object of the invention is to provide an adjustably shielded paint roller which can be quickly and easily adjusted during each paint application by the ordinary consumer.

Another object of the invention is to provide an adjustably shielded paint roller which provides maximum spatter protection when working conditions so require, such as ceilings or corner work, yet which retracts for ease and safety of paint loading.

A further object of the invention is to provide an adjustably shielded paint roller in which a range of shield adjustment from a minimum up to approximately 180° can be provided by the use of only one moving part.

Yet a further object of the invention is to provide a paint roller in which the adjustment of the moveable shield component can be accomplished with one hand; that is, by the same hand which holds the roller. This can be especially advantageous when the user must devote one hand to maintaining or steadying his foothold, as by holding onto a ladder, and has only one hand available for loading and applying paint.

Yet a further object of the invention is to provide an adjustable shielded paint roller as above described in which a minimum shield is provided so as to obtain the benefits described above and, at the same time, the shield can be selectively extended sufficiently far so as to enable the roller to be laid on its back, loaded with paint, without fear of having excess paint drip onto a supporting surface, such as a rug or floor.

The foregoing and other advantages of the invention will become apparent from the following detailed description of the invention.

DESCRIPTION OF THE DRAWINGS

The invention is illustrated more or less diagrammatically in the accompanying drawing wherein.

DETAILED DESCRIPTION OF THE INVENTION

Figure 1:
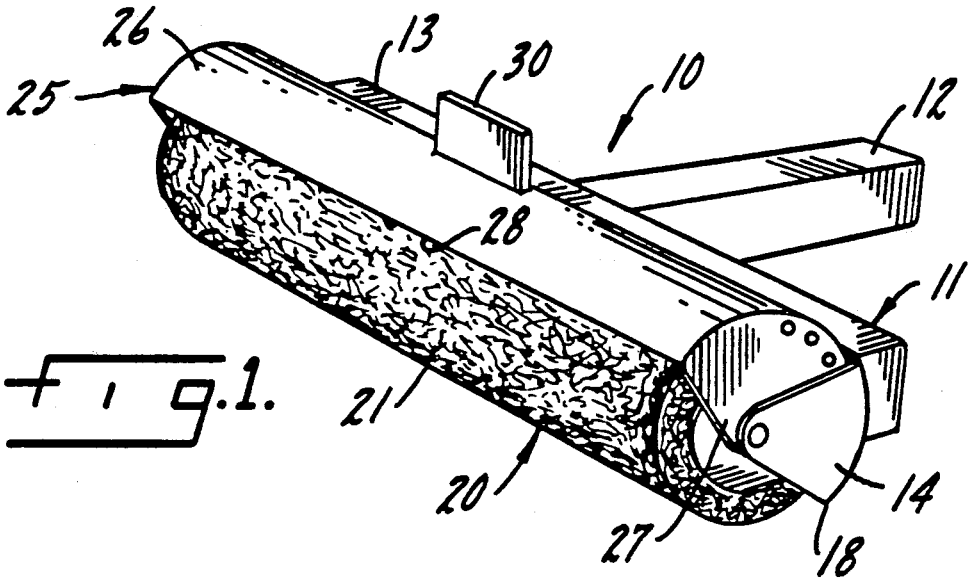
FIG. 1 is a perspective view of an adjustably shielded paint roller assembly in which the adjustable shield is shown in its maximum shielding position

Like reference numerals will be used to refer to like parts from Figure to Figure in the drawing.

The adjustably shielded paint roller assembly of this invention is indicated generally at 10 in FIG. 1. The paint roller assembly includes a yoke, indicated generally at 11, from which a handle 12 projects rearwardly. The yoke 11 can be of any suitable shape or form. In this instance it consists of an elongated mainframe member 13 from which a yoke arm, 14, projects at each end, only one of which is shown in the Figures. Yoke arm 14 includes, in this instance, a pivot opening 15 of a size to receive a roller shaft 16 of a paint roller which is described in detail hereinafter. In this instance, the yoke arm 14 is pie shaped in contour, with the pie segment forming an angle, in this instance, of substantially less than 90°. The mainframe member 13 is shown, in this instance, as a rectangular, box-like structure which is integral with a structural member 17 which extends between the yoke arms 14. Alternatively of course the yoke arms 14 can merely be a pie shaped projection from the mainframe member 13. The yoke arms 14, structural member 17, box-like mainframe member 13 and handle 12 all function as a substantially rigid frame and base shielding member. The handle 12 will, of course, be of a length and shape suitable for easy and convenient grasping and holding during operation by the user.

A conventional paint roller is indicated generally at 20. The paint roller includes a layer of pile fabric 21 which is wrapped about a core, indicated at 22, from which pivot shaft 16 projects. If the yoke arms 14 are made from a material with some flexibility, such as plastic, though metal could also be employed, it is a simple task to manually bend the yoke arms 14 outwardly far enough to snap the paint roller 20 into place by pushing the ends of pivot shaft 16 into the pivot opening 15 in each yoke arm 14.

An adjustable shield member is indicated generally at 25. The adjustable shield 25 consists, in this instance, of a cover section, indicated at 26, which has arms 27 at each end. Each cover arm 27 is generally pie shaped, as indicated best in FIG. 2, and includes a pivot opening of a size suitable for reception of roller shaft 16 near the apex of the included angle. If the adjustable shield 25, and particularly the shield arms 27, are composed of a material having some flexibility, such as plastics or, even, metal, the assembly of the cover arm to the paint roller 20 may be accomplished by manually bending the shield arms 27 outwardly a sufficient amount to permit the roller shaft 16 to snap into place within the pivot aperture, not numbered, at the apex of each shield arm. Preferably, of course, in assembly of the unit, the adjustable shield 25 is assembled to the paint roller 20 first, and thereafter the yoke 11 is snapped onto the roller shaft 16.

Figure 2:
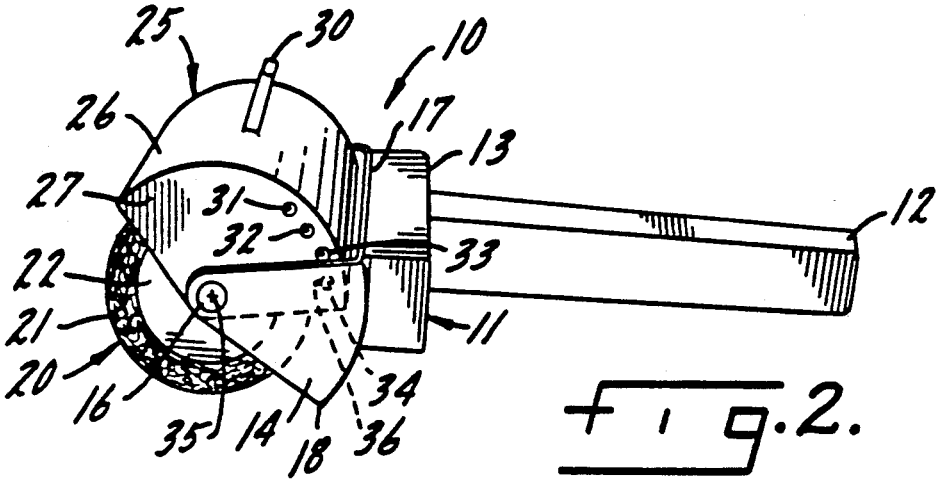
FIG. 2 is generally a side view of the adjustably shielded paint roller assembly of FIG. 1 with parts shown in outline for clarity of description.

The adjustable shield 25 can be retracted into, or extended outwardly from, the yoke 11. In FIG. 2 the adjustable shield 25 is shown in its position of maximum extension from yoke 11, and in FIG. 3 the adjustable shield 25 is shown in its position of maximum retraction into yoke 11.

The position of minimum retraction of adjustable shield 25 into yoke 11, and thereby the minimum angular or circumferential shield coverage of the paint roller, is determined, in this instance, by a locator tab 30 which projects upwardly from the outer surface of cover section 26. In the position of maximum retraction of FIG. 3, further retracting movement of the adjustable shield 25 with respect to the yoke 11 is precluded by locator tab 30 abutting against the edge of structural member 17.

Means for fixing the position of the adjustable shield 25 with respect to yoke 14 at a plurality of discrete positions between a position of minimum retraction and maximum extension is illustrated best in FIG. 2. In this Figure a plurality of depressions 31, 32, 33 and 34 are shown formed in cover arm 27. The depressions 31–34 are located on an arc of curvature whose radius is the axis 35 of roller shaft 16. A button 36 which projects inwardly from the left yoke arm 14 is located in a position to successively engage depressions 34, 33, 32, 31 when the adjustable shield 25 is moved in a retracting direction, and to similarity engage the depressions when the adjustable shield 25 is moved in an extending direction. When button 36 mates with any one of depressions 31–34, the position of adjustable shield 25 is fixed with respect to yoke 11. The depth of depressions 31–34 and the corresponding height of button 36 from its support surface can be readily established by one skilled in the art so that, when the button engages a depression, sufficient restraining force is provided to preclude relative movement between adjustable shield 25 and yoke 11 during normal operation. At the same time, when it is desired for any reason to change the position of the adjustable shield 25 with respect to yoke 11, a simple application of finger pressure to locator tab 30 will cause relative movements between the two parts.

Figure 3:
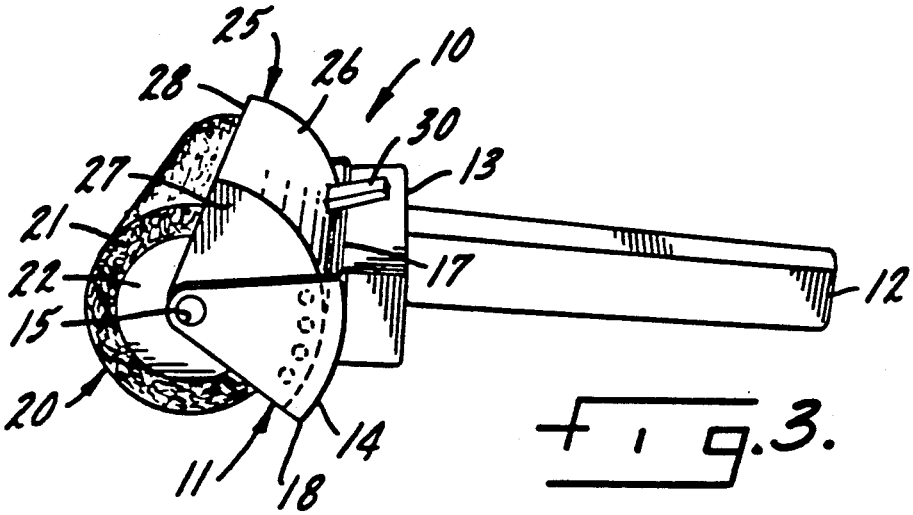
FIG. 3 is generally a side view of the adjustably shielded paint roller assembly of FIG. 1 which illustrates the fully retracted position of the adjustable shield portion of the assembly.

Relative movement between the two parts may be desired each time the roller is loaded with the paint formed in the pool in a paint tray. Thus, for example, when the adjustable shield 25 is in a position of maximum extension with respect to yoke 11, as is illustrated in FIGS. 1 and 2, maximum protection against paint spatter will be provided. This is particularly advantageous when painting a ceiling but is, of course, almost equally advantageous when painting a vertical wall. However, when it is time to reload paint onto the roller, the placement of the adjustable shield 25 into the position of FIGS. 1 and 2 requires that care be taken, by the user, in dipping the pile fabric 21 of the paint roller 20 into the paint tray to prevent dipping either the leading edge 28 of adjustable shield 25 or trailing edge 18 of yoke 11. Consequently, the user, while his hand grasps handle 12, can facilitate the paint loading operation by merely extending a finger forwardly to locator tab 30, and pulling tab 30, and thereby the adjustable shield 25, inwardly toward yoke arm 14. As mentioned, the movement of adjustable shield 25 with respect to yoke arm 11 will stop when locator tab 30 strikes the mainframe member 13. With the pile fabric 21 exposed over almost 270° of its circumference as illustrated in FIG. 3, the pile fabric 21 may be relatively quickly and easily loaded with paint. Following loading, the user operates locator tab 30 to move the adjustable shield 25 back to the fully extended position of FIG. 2, or any intermediate position, represented by depressions 32 and 33, between a fully retracted and a fully extended position.

It will also be noted that if the adjustable shield 25 is extended to its maximum extension position of FIG. 2, the paint roller 10 can be laid on a flat surface with the tip of locator tab 30 and the top of the rear end of handle 12 in contact with the surface, and the shield assembly will intercept any paint which drips from the pile fabric toward the supporting surface. This feature may be particularly important, for example, when the user, just after loading the roller with paint, is required to lay down the roller to answer the telephone or attend to some other immediately pressing matter.

Figure 4:
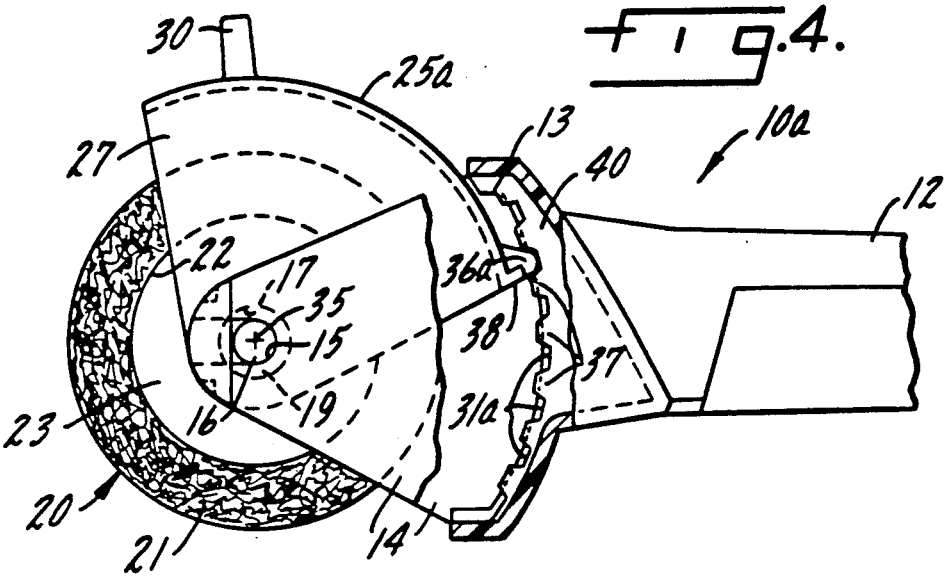
FIG. 4 is a side elevational view of a alternative embodiment of the present invention.
Figure 5:
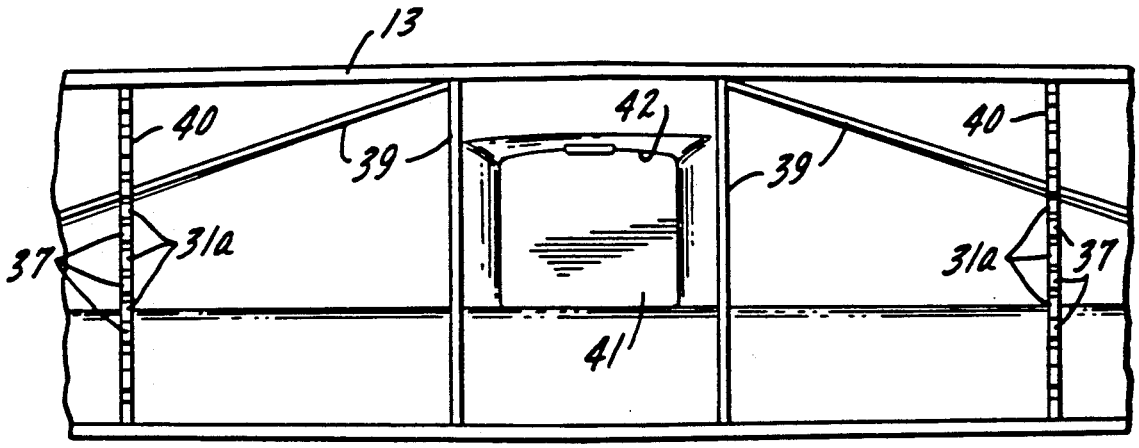
FIG. 5 is an elevational view of the inside of the yoke showing the shield retention means thereof.

FIGS. 4 and 5 show an alternative embodiment of the invention. In describing this alternative, reference numerals used to describe the embodiment of FIGS. 1 through 3 are used to refer to substantially similar parts of the alternative embodiment, and a suffix "a" is used with corresponding reference numerals where similar but substantially modified elements are shown.

The alternative assembly **10*a* includes a handle 12, a mainframe or cross-member 13 with arms 14, which resiliently move away from one another to hold the roller 20. The pivot openings 15 each receive a shaft or post 16 which is part of a roller end support plug 23. The plug 23 frictionally fits into the core 22 so that rotation of the roller 20 causes rotation of the post 16 in the pivot opening 15. The shield 25*a* includes a tab 30 and shield arms 27. The shield arms 27 have pivot openings 17, which are somewhat larger than the pivot openings 15. The pivot opening 17 of the shield arm 27 engages a shoulder 19 at the base of the post 16. The shoulder 19 is larger in diameter, but concentric with the post 16, so that the shield arms 27 can pivot about the axis of the roller without interfering with the yoke arms 14**.

The opening 17 is shaped to loosely but closely fit over the shoulder 19 so that, as the shield rotates, the protrusion **36*a* on the rear edge 38 of the shield is held resiliently into the spaces 31*a* between the bumps 37. The bumps 37 are arranged in an arcuate array on reinforcing ribs 40. The two ribs are disposed on opposite sides of the handle opening 42. The other reinforcing ribs 39 provide structural strength to the mainframe 13. The stopper 41 is a separate small plate which snaps into position to prevent paint from dripping through the inside of the handle 12. The arcuate array of the bumps 37 has a center which is located at the axis 35 of the roller 20 and, consequently, at the center of openings 15 and 17. As with the embodiment of FIGS. 1 through 3, the shield 25***a* can be moved to an extended position in which maximum shielding is provided. When the roller is being loaded with paint, the user can easily retract the shield 25 by applying light force to the tab 30. The flexure of the shield 25 allows the protrusion 36*a* to move in the direction of the axis of the roller, and when the shield is rotated about the shoulder 19, the protrusion can move to and occupy another of the spaces 31*a*.

The adjustability of the shield 25*a* is important when painting an area which is an inside corner, such as where a wall meets another wall, or where a wall meets a ceiling. The shield may need to be in a retracted position to prevent the shield from contacting an intersecting surface.

The tab is operable by the same hand with which a user is holding the paint roller assembly because the tab is on the outside of the shield, it is not likely to have paint splatter on it. Similarly, because it is on the upper part of the shield, it does not readily become covered with paint when the roller is dipped into a paint tray. Therefore, the tab is very likely to remain free of paint. Thus, the tab is unlikely to be a point of transfer of paint to the user's hand.

The shield may be adjusted to positions between the fully extended and fully retracted positions. Such intermediate positions may be desired when a user is reaching to an area where access is limited, or to avoid relocating a ladder. In such cases, shielding may be desired, but exposure of more of the roller may also be desired to provide the user with a greater range of angles (relative to the surface being painted) at which the handle may be held.

Although two embodiments of the invention have been illustrated and described, it will at once be apparent to those skilled in the art that modifications may be made to the illustrated and described embodiments without departing from the spirit and scope of the invention. Accordingly, it is intended that the scope of the invention be limited solely by the scope of the appended claims, when interpreted in light of the relevant prior art, and not by the specific description of the above embodiments.

We claim:

1. In an adjustably shielded paint roller assembly, a paint roller, a rigid frame including a handle for carrying the roller, pivot means for mounting the paint roller for rotational movement about a fixed axis on the rigid frame, two cooperating shielding members, a first base shielding member and a second adjustable shielding member, said arcuate base shielding member having a fixed arcuate size which is located between the axis of rotation and handle and extending across the length of said roller so as to intercept spatter emanating from the roller during use, and said adjustable arcuate shielding member at least partially retractable into the base shielding member to a first use position in which a minimum degree of spatter shielding is provided, said adjustable arcuate shielding member being moveable to a second use position in which a maximum degree of spatter shielding is provided, said roller being usable to apply paint when said shielding member is in said first use positions and when in said second use position, said arcuate base shielding member and said adjustable arcuate shielding member having a combined arcuate extent of about half of the circumference of said roller when extended into said second use position, position adjustment means for adjustably fixing the adjustable arcuate shielding member at positions between said first and second use positions, said position adjustment means comprising cooperating engaging formations integrally formed with and carried by said adjustable shielding member and said base shielding member, at least one of said shielding members being sufficiently flexible and resilient so as to allow selective sliding engagement and disengagement of said formations, said adjustable arcuate shielding member having actuating means which protrudes radially outwardly from said adjustable arcuate shielding member so as to be readily reachable by a user to adjust the extent of shielding provided by said adjustable arcuate shielding member.

* * * * *